United States Patent [19]

Jirovetz

[11] Patent Number: 4,519,533

[45] Date of Patent: May 28, 1985

[54] APPARATUS FOR DRIVING OFFSET FASTENERS

[75] Inventor: Andre Jirovetz, Sturgeon Bay, Wis.

[73] Assignee: Fal-Kon Investment Group, Sturgeon Bay, Wis.

[21] Appl. No.: 487,684

[22] Filed: Apr. 22, 1983

[51] Int. Cl.[3] ..... B25C 1/04

[52] U.S. Cl. ..... 227/109; 227/120; 227/156

[58] Field of Search ..... 227/19, 109, 110, 111, 227/120, 121, 130, 147, 148, 156

[56] References Cited

U.S. PATENT DOCUMENTS

| | | | |
|---|---|---|---|
| 692,740 | 2/1902 | Van Auken | 227/109 |
| 2,332,257 | 10/1943 | Polzer . | |
| 3,589,586 | 6/1971 | Mazzer | 227/130 |
| 3,720,364 | 3/1973 | Maestri | 227/109 |
| 3,742,557 | 7/1973 | Buttriss | 29/212 R |
| 3,858,780 | 1/1975 | Perkins et al. | 227/8 |
| 4,139,136 | 2/1979 | Catalano | 227/109 |
| 4,174,802 | 11/1979 | Maestri | 227/109 |
| 4,197,974 | 4/1980 | Morton et al. | 227/120 X |
| 4,200,214 | 4/1980 | Bobren | 227/109 |
| 4,256,251 | 3/1981 | Moshofsky | 227/120 |
| 4,294,391 | 10/1981 | Obergfell | 227/130 |
| 4,304,349 | 12/1981 | Novak et al. | 227/109 |
| 4,326,661 | 4/1982 | Maurer et al. | 227/120 |
| 4,391,402 | 7/1983 | Campbell et al. | 227/121 |

FOREIGN PATENT DOCUMENTS

| | | |
|---|---|---|
| 5188283 | 2/1978 | Japan . |

*Primary Examiner*—Paul A. Bell

*Attorney, Agent, or Firm*—Willian Brinks Olds Hofer Gilson & Lione Ltd.

[57] ABSTRACT

An apparatus for driving offset fasteners including a pneumatic body, piston housing, reciprocating piston and cartridge. The cartridge includes a stepped track plate and spring member. The spring member and plate cooperate to secure and urge the offset fasteners successively into the piston housing. Connected to an end of the reciprocating piston is a striker bar for driving the offset fasteners out of the piston housing. The piston housing includes a biasing member for preventing an offset fastener from entering the piston housing immediately after an offset fastener has been ejected.

14 Claims, 7 Drawing Figures

APPARATUS FOR DRIVING OFFSET FASTENERS

BACKGROUND OF THE INVENTION

The present invention relates to an apparatus for driving offset fasteners. Specifically, the invention is directed to an apparatus for driving offset fasteners into stud plates and the like so that tackless carpet strips may be secured thereto.

One of the most popular methods for securing carpeting to a floor is to utilize so called "tackless strip." These strips consist of a strip of wood or other material which includes metal tacks or flanges extending outwardly therefrom which are designed to secure a portion of the carpeting. Tackless strips provide a method of securing carpeting to the floor without the need for tacking the carpet itself to the floor. Instead, the strips are secured to the floor or stud plate and the carpet is secured to the strips.

There are basically four methods for securing tackless strip on the floor next to a wall. One method is to glue or cement the strips to the floor. This method of securing tackless strip is not only time consuming but in many instances is not possible due to conditions of the floor. Moreover, there is also a problem that sometimes the glue or cement fails causing the strips to no longer be secured to the floor.

A second method of securing tackless strip to the floor near the wall is to use nails which are driven through the strip into the floor. This is probably the most popular method but suffers some drawbacks. One problem with using nails is that sometimes the nails will cause concrete on the outside wall to break as the nails are driven. There is also a problem that sometimes the concrete which comprises the floor is so hard that nails can not be easily driven into it and/or will not hold; on the other hand, if the concrete is too soft the nails will also not hold. An additional problem is present if the concrete comprising the floor is uneven or wavy.

A related method of securing tackless strip is to drill holes and use concrete pins. While this method alleviates some of the aforementioned problems, as can easily be appreciated this method is very time consuming. Moreover, there is also a problem of drilling holes and/or securing pins in concrete which is either too hard or soft.

A fourth method of securing tackless strip entails the use of offset fasteners which are driven into the stud plate at its base, parallel to the floor. The offset fasteners include a flanged head which is designed to receive a portion of the tackless strip securing it to the floor at the wall. Offset fasteners are designed to be used any place where there is a wood frame construction over a concrete floor. They are particularly useful if the floor is wavy because the fastener will always enter the stud plate, even if the plate bridges a dip in the concrete floor.

The prior art heretofore, has not had a power tool for driving offset fasteners into stud plates or the like so that tackless strip may be secured. The prior methods of driving the offset fasteners into a stud plate have involved the use of a drive tool and hammer. One method entails the use of a metal drive tool which is designed to secure a portion of the offset fastener. The offset fastener is positioned against the stud plate by the tool and struck with a hammer driving it into the wall. Thus, while it may be advantageous, or even necessary, to utilize offset fasteners to secure tackless strip, the prior art has not provided a power tool for driving an offset fastener into a stud plate so that tackless strip may be secured in an expedient fashion.

There is, therefore a need for a power tool for driving an offset fastener into a stud plate so that tackless strip may be secured.

SUMMARY OF THE INVENTION

The present invention is directed to an apparatus for driving offset fasteners into stud plates and the like so that tackless carpet strips may be secured thereto. The apparatus includes a pneumatic body, piston housing, and cartridge. The piston housing is designed to enclose a reciprocating piston which has attached thereto a striker bar. Offset fasteners are fed from a cartridge into the piston housing where they are driven by the striker bar.

The cartridge of this invention is designed to feed offset fasteners into the piston housing. To this end, the cartridge includes a stepped track plate of substantially similar shape to the offset fastener. In a preferred embodiment, the stepped track plate includes an abutment plate which is adjustable to allow for varying sizes of offset fasteners to be utilized in the cartridge. To secure the offset fasteners to the cartridge plate and to urge the fasteners into the piston housing a constant force spring is provided.

In a further preferred embodiment, the striker bar includes a striker member which has a concave face.

In an additional preferred embodiment, the piston housing includes a biasing member which prevents offset fasteners from entering the piston housing as the striker bar is returning to its original position.

Accordingly, an advantage of the present invention is to provide a power tool for driving offset fasteners into stud plates to that they may secure tackless strip.

A further advantage of the present invention is to provide a cartridge for feeding offset fasteners into a piston housing where they may be driven.

An additional advantage of the present invention is to provide a striker bar with a concave face designed to drive offset fasteners.

A further advantage of the present invention is to provide biasing means in the piston housing for preventing offset fasteners from being fed into the piston housing as the striker bar is returning to its original position.

Another advantage of the present invention is to provide an apparatus for allowing offset fasteners to be driven parallel to the floor into a stud plate.

Additional features and advantages are described in, and will be apparent from, the detailed description of the preferred embodiments and from the drawings.

DETAILED DESCRIPTION OF THE PRESENTLY PREFERRED EMBODIMENTS OF THE INVENTION

Figure 1:
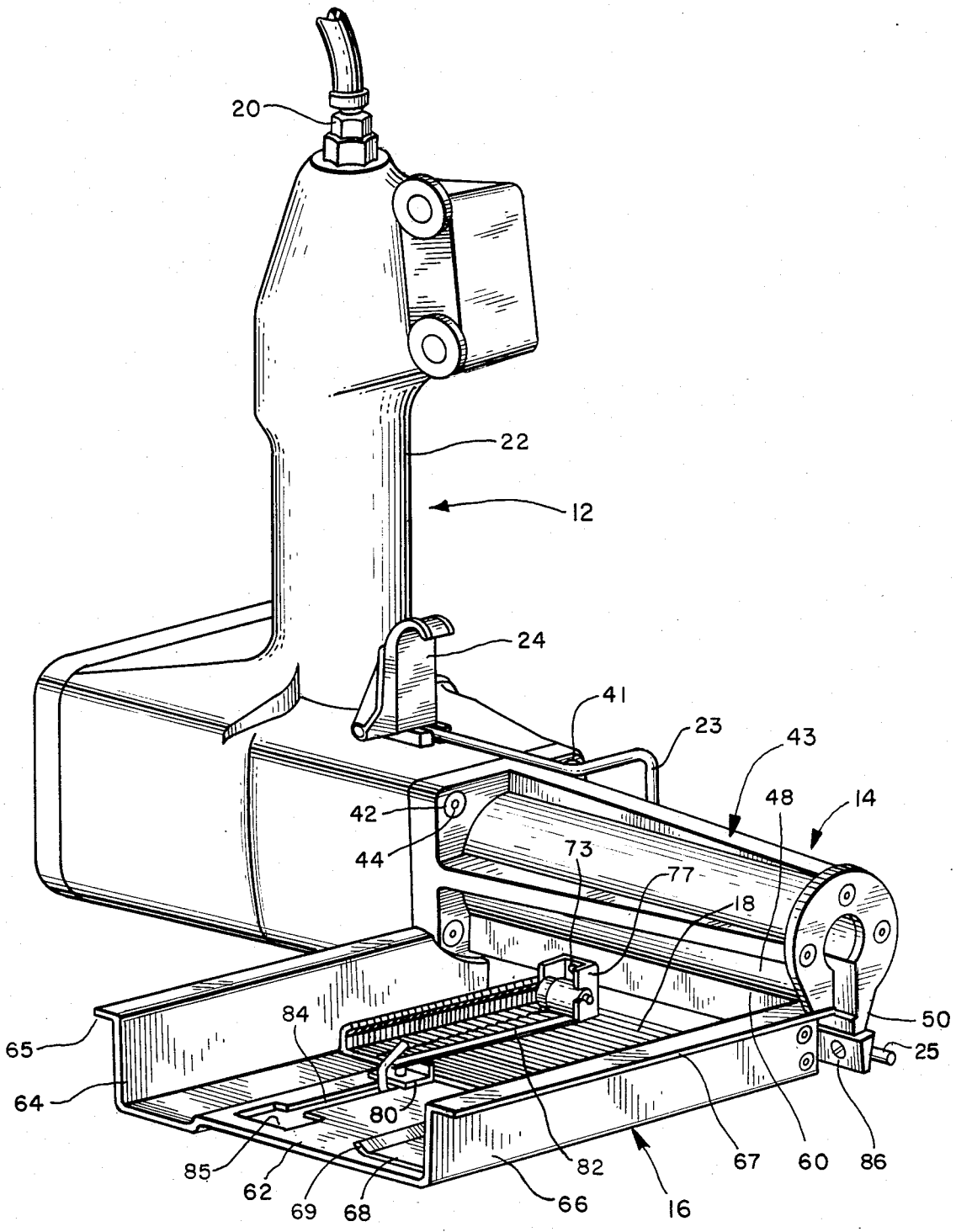
FIG. 1 illustrates a perspective view of a preferred embodiment of the apparatus for driving offset fasteners.

FIG. 1 illustrates a perspective view of a preferred embodiment of the apparatus for driving an offset fastener 10 which includes a pneumatic body 12, piston housing 14 and cartridge 16. The apparatus 10 is specifically designed to drive offset fasteners 18 into a stud plate parallel to the floor so that they can secure tackless strips to the floor.

The pneumatic body 12 is of a basic design known in the art and includes a compressed air inlet 20, handle 22 and control lever 24. Located within the pneumatic body 12 is a reciprocating piston 26. By depressing the lever 24 one is able to cause the piston 26 to move to-and-fro in response to compressed air. The pneumatic body 12 may include a safety bar 23. The safety bar 23 is constructed so that when the front end 25 of the safety bar 23 is forced rearwardly, by being pushed against a stud plate or like, it allows the control lever 24 to be actuated. Otherwise, the safety bar 23 prevents the lever 24 from being actuated.

Figure 2:
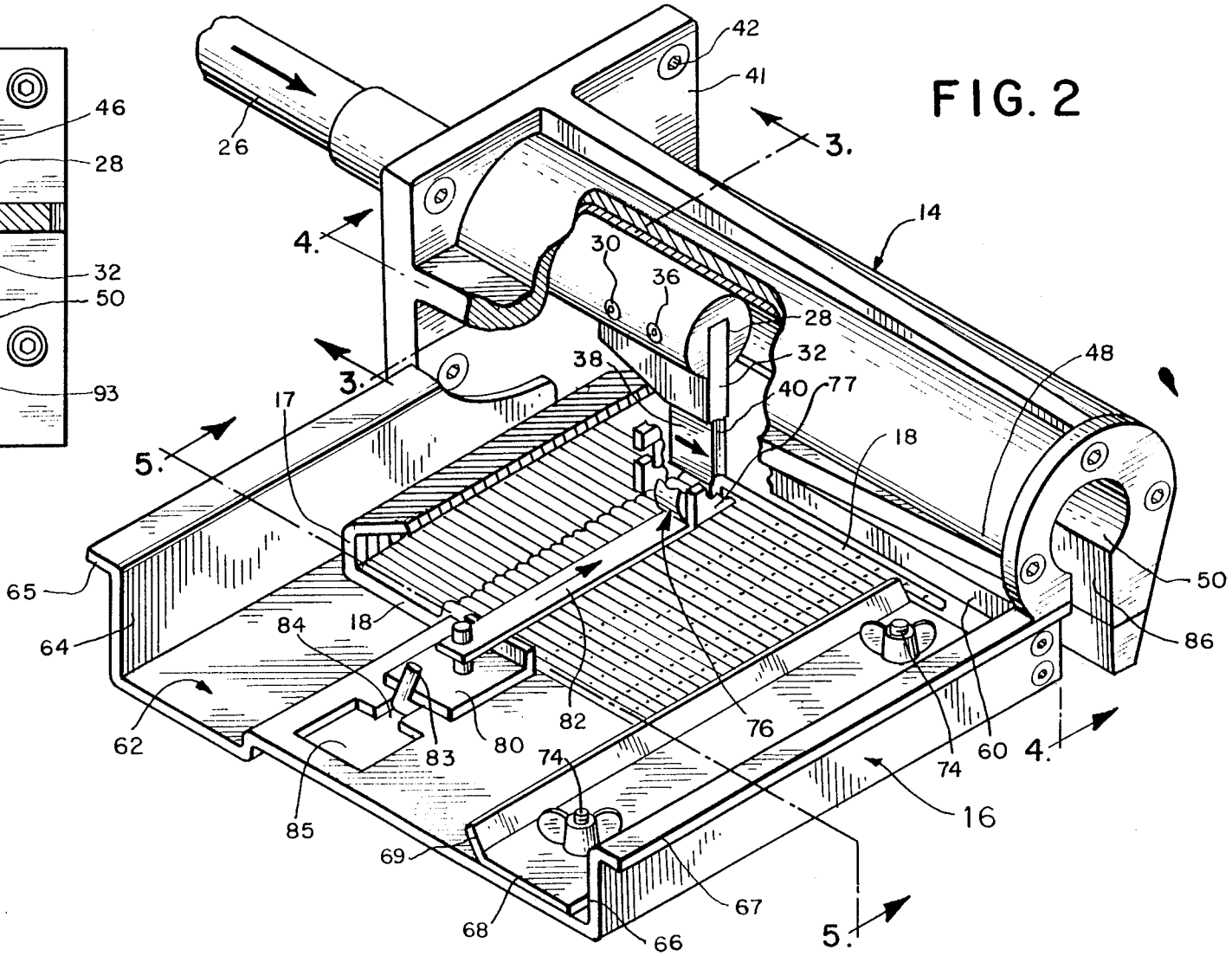
FIG. 2 illustrates a top elevational view of a preferred embodiment of the cartridge, piston housing and piston, with parts broken away of the apparatus for driving offset.

Referring now to FIG. 2, the reciprocating piston 26 includes a slotted portion 28 which includes apertures 30. The slotted portion 28 is designed to receive a striker bar 32 which includes apertures (not shown). When the striker bar 32 is received within the slotted portion 28, the apertures in the slotted portion and striker bar are coextensive so that they may receive pins 36 which secure the striker bar 32 to the piston 26. The striker bar 32 is designed to strike, and thereby drive, offset fasteners 18 which have been feed into the piston housing 14. To this end, as will be described in greater detail below, the striker bar 32 includes a striker member 38 which has a concave face 40 designed to strike the offset 15 of an offset fastener 18.

The reciprocating piston 26 and striker bar 32 are enclosed within a piston housing 14. The piston housing 14 includes a back plate 41 which includes apertures 42 which allow the back plate 41, and thereby the piston housing 14, to be secured to the pneumatic body 12 by screws 44. Extending from the back plate 41 is a slotted column 43 which includes a first side wall 48 and a second side wall 50. Located within the slotted column 43 is a slotted bearing tube 46. The bearing tube 46 is slotted to allow the reciprocating piston 26 and thereby the striker bar 32 to move to-and-fro within the tube 46.

Figure 5:
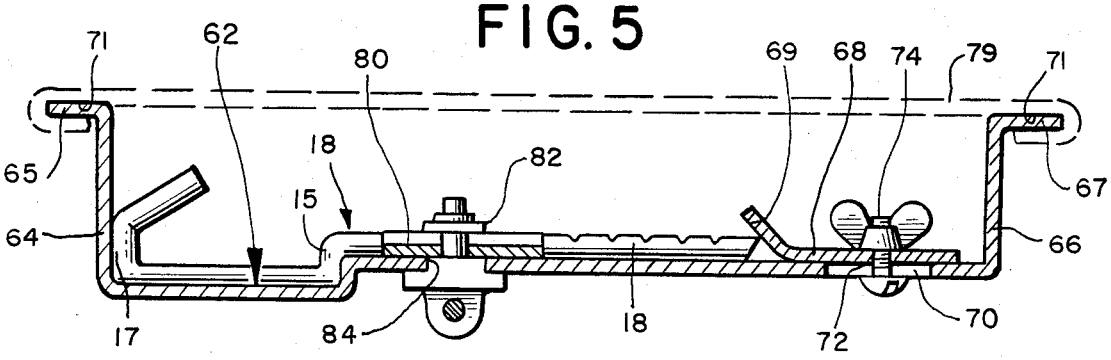
FIG. 5 illustrates a cross-sectional view taken along lines 5—5 of FIG. 2.

Referring now to FIGS. 2 and 5, the cartridge 16 for feeding the offset fastener 18 into the piston housing 14 is illustrated. The cartridge 16 is secured to the first side wall 48 of the piston housing 14 by a cartridge support bar 60. The cartridge support bar 60 is designed to secure the cartridge 16 to the piston housing 14 so that offset fasteners 18 may be fed into the piston housing 14.

The cartridge 16 includes a stepped track plate 62 which includes a top wall 64 and a bottom wall 66. The track plate 62 is stepped so that it has a shape which substantially conforms to the shape of the offset fasteners 18. The shape of the stepped track plate 62 allows the offset fasteners 18 to be laid in an upright position on the track plate with their heads 17 positioned against the top wall 64.

The stepped track plate 62 also includes an abutment plate 68 which is designed to abut the bottom end of the offset fasteners 18 when the fasteners are positioned on the stepped track plate 62. The position of the abutment plate 68 with respect to the top and bottom walls 64 and 66 of the track plate 62 is adjustable so that different lengths of offset fasteners 18 may be utilized within the cartridge 16. To this end, the stepped track plate 62 includes slots 70 and the abutment plate includes apertures 72. The slots 70 in the track plate 62, allow the abutment plate to be secured to the track plate at a variety of positions by wing nuts 74. Thus, the abutment plate 68 is adjustably positioned on the stepped track plate 62 with respect to the top and bottom walls 62 and 64 by wing nuts 74.

As illustrated in FIG. 5, in a preferred embodiment, the abutment plate 68 includes an angled flange 69. The angled flange 69 helps to secure the offset fasteners 18 to the track plate 62.

To feed the offset fasteners 18 into the piston housing 14, a constant force spring 76 is provided. As will be described below, the constant force spring 76 also functions to secure the offset fasteners 18 to the stepped track plate 62. The constant force spring 76 includes a bracket member 77 which is secured to the cartridge support bar 60 by screws 73, a plate member 80 and a spring member 82. The plate member 80 is designed to abut the last offset fastener 18 on the track plate 62 and urge it towards the piston housing 14. To this end, the plate member 80 is received within a slot 84 in the stepped track plate 62. The spring member 82 extends from the bracket member 77 to the plate member 80 so that when the plate member 80 is located within the slot 84, the spring member 82 urges the plate member 80 towards the piston housing 14.

The slot 84 in the stepped track plate, includes a rectangular portion 85 which allows the plate member 80 to disengage or engage the slot 84. To this end, the plate member 80 includes a flange 83 which may be grasped when engaging or disengaging the plate member 80 from the slot 84. This allows one to load the offset fasteners 18 onto the stepped track plate 62 and thereby into the cartridge 16.

The spring member 82 not only functions to urge the offset fasteners 18 into the piston housing 14 but also secures the offset fasteners 18 against the surface of the stepped track plate 62. Thus, a plurality of offset fasteners 18 may be located in an upright position on the stepped track plate 62, and thereby in the cartridge 16.

The top and bottom walls 64 and 66 of the stepped track plate 62 each include a lip member 65 and 67 respectively. The lip members 65 and 67 of the walls 64 and 66 are designed to secure a cover 79 over the stepped track plate 62, and thereby over the offset fasteners 18. To this end, the cover 79 includes slots 71 which are designed to receive the lip members 65 and 67 and thereby snap onto the stepped track plate 62.

Figure 3:
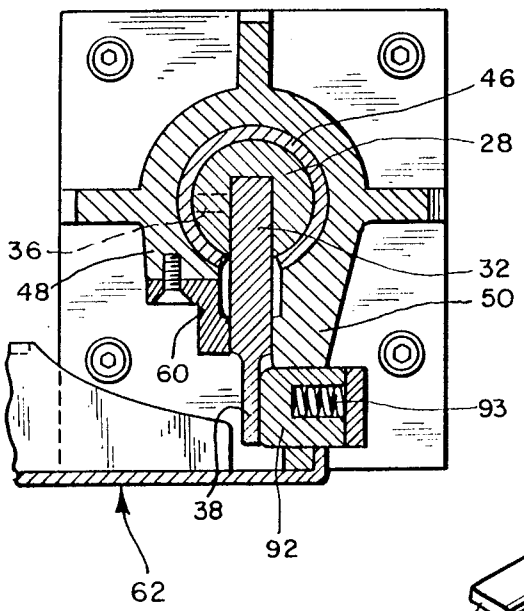
FIG. 3 illustrates a cross-sectional view taken along lines 3—3 of FIG. 2.

Referring now to FIGS. 2 and 3, the first side wall 48 of the slotted column 43 is constructed so that the offset fasteners 18 may be fed into the piston housing 14 when the cartridge 16 is attached thereto. To this end, the first side wall 48 is shorter than the second side wall 50. Thus, the offset fasteners 18 are fed into the piston housing 14, under the first side wall 48 and urged against the second side wall 50. The second side wall 50 includes a bearing surface 86 against which an offset fastener 18 is positioned as it is fed into the housing 14 before being struck by the striker bar 32. The bearing surface 86 provides a surface from which the offset fastener 18 may be driven by the striker bar 32. The distance between the first and second side wall 48 and 50 is such that only one offset fastener 18 may be fed into the piston housing 14 at a time.

Figure 6A:
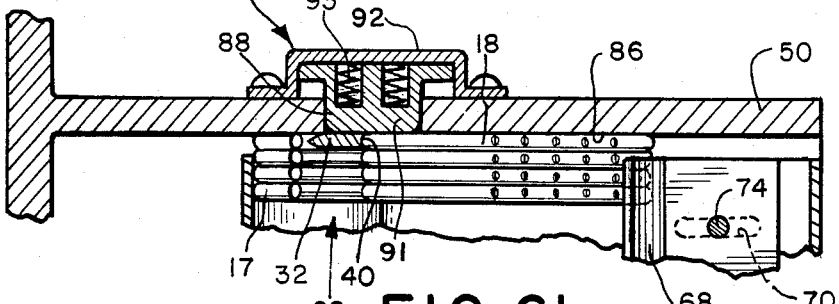
FIG. 6*a* illustrates a cross-sectional view taken along lines 6*a*—6*a* of FIG. 4.
Figure 6B:
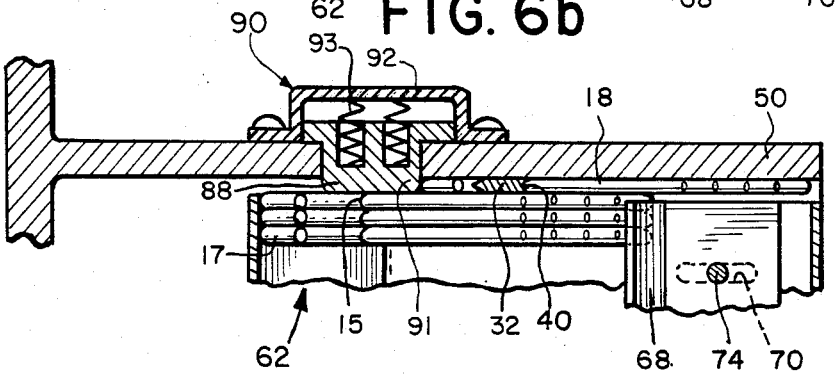
FIG. 6*b* illustrates a cross-sectional view taken along lines 6*a*—6*a* depicting the striker member driving an offset fastener.

As illustrated in FIG. 6*a*, the striker bar 32, includes a striker member 38 which has a concave face 40. The concave face 40 of the striker member 38 is designed to assure that the striker bar 32 accurately strikes the offset 15 of the offset fastener 18. The striker member 38 is designed to strike the offset 15 and not the head 17 to insure that the offset fastener 18 is not bent as it is driven into a stud plate. Thus, the striker bar 32 is able to drive the offset fastener 18 in a straight line into a stud plate or other object.

Because the striker bar 32 is secured to the reciprocating piston 26, it moves to-and-fro with the piston. After the striker bar 32 has driven an offset fastener 18 from the piston housing 14 it is returned to its original position with the reciprocating piston 26. After the striker bar 32, and thereby the piston 26, have returned to their original position, another offset fastener 18 may be fed into the piston housing 14 and driven by the striker member 32.

To prevent a second offset fastener 18 from entering the piston housing 14 during the return sequence, and thereby preventing the reciprocating piston 26 and striker bar 32 from returning to their ready position, a biasing member 90 is provided. As illustrated in FIGS. 6*a* and 66, the biasing member 90 extends from a notch 88 in the bearing surface 86 of the second side member 50. The biasing member 90 includes a bar 91 which is urged into the piston housing 14 by springs 93 and a plate 92 which secures the biasing member 90 to the second side wall 50.

The biasing member 90 prevents offset fasteners 18 from entering the piston housing 14 as the striker bar 32 returns after it has ejected an offset fastener 18. Thus, the biasing member 90 allows the striker bar 32 and reciprocating piston 26 to return to their ready position. To this end, as the reciprocating piston 26 returns to its ready position, the striker bar 32 urges the plate 92 of the biasing member 90 back into the notch 88 in the bearing surface 86 allowing an offset fastener 18 to enter the piston housing 14.

Figure 4:
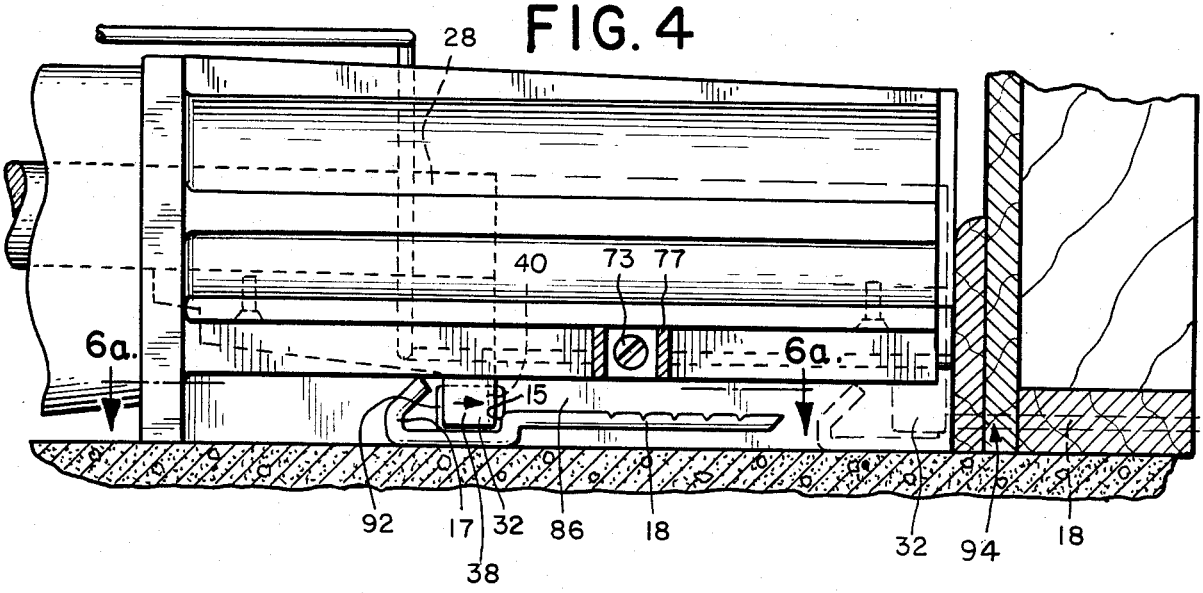
FIG. 4 illustrates a cross-sectional view taken along lines 4—4 of FIG. 2, and depicts an offset fastener in phantom lines driven into a stud plate.

As stated above, the apparatus 10 is specifically designed to drive offset fasteners 18 into stud plates and the like so that they may secure tackless strip. To this end, in use, the cartridge 16 is loaded with offset fasteners 18 by removing the plate member 80 from slot 84. Once the offset fasteners 18 have been positioned on the stepped track plate 62 the plate member 80 is received within slot 84 securing the fasteners 18 and urging them into the piston housing 14. The apparatus is then located so that the piston housing 14 is touching the stud plate 94 into which the offset fasteners 18 are to be driven. To this end, the apparatus 10 is positioned so that it is resting on the cartridge 16, as illustrated in FIG. 4. This allows the fasteners 10 to be driven parallel to the floor into the stud plates. As each offset fastener 18 is driven, another fastener 18 is urged into the piston housing 14 permitting the apparatus 10 to rapidly drive the fasteners.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. An apparatus for driving offset fasteners of the type comprising an elongated shank, a head at one end of the shank, and a portion offset from the centerline of the shank being intermediate the head and the shank, the apparatus comprising:

a piston;

a piston housing enclosing the piston;

said piston housing also defining a staging position from which offset fasteners may be driven; and a striker bar attached to the piston for driving a fastener in said staging position, said striker bar including a striker member positioned such that the striker member contacts the offset of said offset fastener when the striker bar drives the offset fastener.

2. The apparatus of claim 1 wherein the piston reciprocates and is pneumatically powered.

3. The apparatus of claim 2 wherein the piston reciprocates along a path of travel and the point at which said striker member contacts said offset of said offset fastener lies outside the volume encompassed by the piston and the piston's path of travel.

4. The apparatus of claim 3 wherein said striker member has a concave face.

5. The apparatus of claim 4 further comprising: a cartridge for supporting and feeding a plurality of offset fasteners into said staging position defined by said piston housing.

6. The apparatus of claim 5 wherein the cartridge further comprises a stepped track plate for supporting offset fasteners and a constant force spring for urging offset fasteners into said piston housing.

7. The apparatus of claim 6 wherein said cartridge includes an abutment plate secured to said stepped track plate for positioning offset fasteners on said stepped track plate.

8. The apparatus of claim 7 wherein the position of said abutment plate may be varied to allow fasteners of different lengths to be supported on said stepped track plate.

9. The apparatus of claim 8 wherein the piston housing includes biasing means for preventing an offset fastener from entering said piston housing immediately after a fastener has been driven by said striker bar.

10. A pneumatic apparatus for driving offset fasteners of the type comprising an elongated shank, a head at one end of the shank, and a portion offset from the centerline of the shank being intermediate the head and the shank, the apparatus comprising:

a piston housing;

a piston enclosed in said piston housing;

pneumatic means for causing said piston to move to-and-fro;

said piston including a striker bar;

a cartridge for feeding a plurality of offset fasteners successively into said piston housing into a position to be driven from said piston housing by said striker bar;

said sticker bar including a striker member positioned to contact the offset of an offset fastener positioned in said piston housing; and said cartridge including a stepped track plate of a shape substantially similar to said offset fasteners for supporting said fasteners.

11. The apparatus of claim 10 wherein said piston housing includes a biasing member for preventing an offset fastener from being fed into said piston housing immediately after an offset fastener has been driven from said piston housing.

12. The apparatus of claim 10 wherein said cartridge includes a constant force spring and plate member for urging the offset fasteners into the piston housing and for securing the offset fasteners to said stepped track plate.

13. The apparatus of claim 10 wherein said striker member has a concave face.

14. The apparatus of claim 10 wherein the piston, piston housing, striker bar and cartridge cooperate to allow the striker bar to drive an offset fastener parallel to a floor and into a stud plate.

* * * * *

UNITED STATES PATENT AND TRADEMARK OFFICE

CERTIFICATE OF CORRECTION

PATENT NO. : 4,519,533
DATED : May 28, 1985
INVENTOR(S) : Andre Jirovetz

It is certified that error appears in the above-identified patent and that said Letters Patent is hereby corrected as shown below:

Title page:

IN THE REFERENCES CITED - U.S. PATENT DOCUMENTS

In line 5, please delete "3,742,557" and substitute therefor --3,742,577--.

In column 2, line 37, please delete "to" and substitute therefor --so--.

In Claim 10 (column 6, line 66), please delete "sticker" and substitute therefor --striker--.

Signed and Sealed this

*Twenty-third* Day of *September 1986*

[SEAL]

*Attest:*

DONALD J. QUIGG

*Attesting Officer*

*Commissioner of Patents and Trademarks*